US010267337B2

(12) United States Patent
Tsubokawa

(10) Patent No.: US 10,267,337 B2
(45) Date of Patent: Apr. 23, 2019

(54) VACUUM PUMP AND METHOD OF MANUFACTURING VACUUM PUMP

(71) Applicant: SHIMADZU CORPORATION, Kyoto (JP)

(72) Inventor: Tetsuya Tsubokawa, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 749 days.

(21) Appl. No.: 14/719,943

(22) Filed: May 22, 2015

(65) Prior Publication Data

US 2015/0345494 A1 Dec. 3, 2015

(30) Foreign Application Priority Data

Jun. 3, 2014 (JP) ..... 2014-114996

(51) Int. Cl.

| | |
|---|---|
| ***F04D 19/04*** | (2006.01) |
| ***F04D 29/52*** | (2006.01) |
| ***F04D 29/58*** | (2006.01) |
| ***F04D 29/64*** | (2006.01) |

(52) U.S. Cl.

CPC ..... *F04D 29/644* (2013.01); *F04D 19/044* (2013.01); *F04D 29/522* (2013.01); *F04D 29/5853* (2013.01); *Y10T 29/49243* (2015.01)

(58) Field of Classification Search

CPC ..... F04D 19/04; F04D 19/042; F04D 25/06; F04D 29/522; F04D 29/601; F04D 29/64–29/644; Y10T 29/49243

USPC .... 417/423.4, 360, 363, 373, 423.8, 423.14, 417/423.15

See application file for complete search history.

(56) References Cited

U.S. PATENT DOCUMENTS 3,168,977 A * 2/1965 Garnier ..... F04D 19/042 415/100
3,628,894 A * 12/1971 Ferguson, Jr. ..... F04D 19/04 415/90
3,749,528 A * 7/1973 Rousseau ..... F04D 19/042 417/423.4
4,036,565 A * 7/1977 Becker ..... F04D 19/048 310/67 R (Continued)

FOREIGN PATENT DOCUMENTS

CN 103671138 A 3/2014
JP 2010-031678 A 2/2010

(Continued)

OTHER PUBLICATIONS

Office Action for Japanese Patent App. No. 2014-114996, dated Jan. 17, 2018.

(Continued)

*Primary Examiner* — Alexander B Comley
*Assistant Examiner* — Benjamin Doyle
(74) *Attorney, Agent, or Firm* — Renner Otto Boisselle & Sklar, LLP

(57) ABSTRACT

A vacuum pump comprises a cylindrical rotor; a cylindrical stator which discharges gas in cooperation with the rotor; and a tubular base to which the stator is fixed. The stator has no fitting structure with respect to the base and is fixed to the base in a concentric state. A pin hole is formed on the stator and the base respectively, and a positioning pin for achieving the concentric state is inserted into each pin hole.

9 Claims, 12 Drawing Sheets

(56) References Cited

U.S. PATENT DOCUMENTS 5,059,092 A * 10/1991 Kabelitz ..... F04D 19/048 415/90
5,166,566 A * 11/1992 Bernhardt ..... F16C 32/0425 310/90
5,652,473 A * 7/1997 Delamare ..... F04D 19/048 310/156.26
6,062,810 A * 5/2000 Miyamoto ..... F04D 17/168 251/318
6,217,278 B1 * 4/2001 Shiokawa ..... F04D 17/168 415/151
6,220,831 B1 * 4/2001 Shiokawa ..... F04D 17/168 417/295
6,419,461 B2 * 7/2002 Okada ..... F04D 19/042 417/373
6,575,713 B2 * 6/2003 Ohtachi ..... F04D 19/04 417/353
6,877,963 B2 * 4/2005 Beyer ..... F04D 19/048 310/90.5
2003/0095863 A1 * 5/2003 Okudera ..... F04D 19/04 415/90
2003/0180162 A1 * 9/2003 Beyer ..... F04D 19/048 417/353
2005/0244219 A1 * 11/2005 Mathes ..... F04D 19/04 403/335
2006/0281352 A1 * 12/2006 Kabasawa ..... H01R 13/631 439/247
2011/0103934 A1 * 5/2011 Ohtachi ..... F04D 19/042 415/118
2013/0147296 A1 * 6/2013 Kozaki ..... H02K 7/09 310/90.5
2013/0189089 A1 * 7/2013 Schroder ..... F04D 19/042 415/182.1
2013/0224042 A1 * 8/2013 Ohfuji ..... F04D 19/042 417/44.1
2014/0072417 A1 3/2014 Tsutsui
2014/0377106 A1 * 12/2014 Kozaki ..... F04D 19/042 417/423.12
2015/0345494 A1 * 12/2015 Tsubokawa ..... F04D 19/042 418/220
2016/0025096 A1 * 1/2016 Shi ..... F04D 19/042 417/423.1

FOREIGN PATENT DOCUMENTS

JP 2011-080407 4/2011
JP 2013-217226 10/2013
WO 2010/007975 1/2010

OTHER PUBLICATIONS

Chinese Office Action (English Translation) dated Aug. 11, 2017 for corresponding Chinese application No. 201510181589.4.

* cited by examiner

VACUUM PUMP AND METHOD OF MANUFACTURING VACUUM PUMP

BACKGROUND OF THE INVENTION

1. Field of the Invention

The present invention relates to a vacuum pump and a method of manufacturing a vacuum pump.

2. Description of the Related Art

Conventionally, there has been used a vacuum pump such as a turbo-molecular pump for chamber evacuation in a semiconductor manufacturing apparatus, a liquid crystal manufacturing apparatus, or the like. In an etching process performed by a semiconductor manufacturing apparatus or a liquid crystal manufacturing apparatus, reaction products are disadvantageously deposited on a vacuum pump. In view of this, there is known a method of increasing the temperature of a pump by heating means to suppress deposition of the reaction products. For example, in a vacuum pump disclosed in JP 2011-80407 A, since reaction products are likely to be deposited on an exhaust unit which includes a cylindrical rotor and a stator (screw stator), a heater is embedded in the stator to directly heat the stator to increase the temperature of the stator.

In a vacuum pump in which a rotor rotates at high speed with a tiny gap with respect to a stator, it is necessary to concentrically arrange the rotor and the stator. Thus, when the stator is fixed to a base, a shaft section of the stator and a hole of the base are allowed to have a fitting relation with a clearance of approximately 0.1 mm in the fixing part to position the stator.

However, when a heater is disposed on the stator to heat the stator as described above, the clearance becomes smaller due to thermal expansion, which causes the entire circumference of the shaft section to come into contact with the hole. As a result, heat of the stator having high temperature disadvantageously escapes to the base having low temperature to thereby decrease the temperature of the stator.

SUMMARY OF THE INVENTION

A vacuum pump comprises: a cylindrical rotor; a cylindrical stator which discharges gas in cooperation with the rotor; and a tubular base to which the stator is fixed. The stator has no fitting structure with respect to the base and is fixed to the base in a concentric state.

pin holes are formed on the stator and the base respectively, and positioning pins for achieving the concentric state are inserted into each pin holes.

The stator and the base respectively include abutment section having a radial gap formed therebetween in the concentric state and coming into contact with each other when the stator is radially shifted to prevent contact between the stator and the rotor.

A vacuum pump comprises: a cylindrical rotor; a cylindrical stator which discharges gas in cooperation with the rotor; and a base fixed to the stator in a concentric state. The stator and the base respectively include abutment section having a radial gap formed therebetween in the concentric state and coming into contact with each other when the stator is radially shifted to prevent contact between the stator and the rotor.

A method of manufacturing a vacuum pump, the vacuum pump including a cylindrical rotor, a cylindrical stator discharging gas in cooperation with the rotor, and a tubular base to which the stator is fixed, the method comprises: positioning the stator with respect to the base in a concentric state using a positioning jig; fixing the stator to the base in the concentric state; and removing the positioning jig after the stator is fixed to the base.

The present invention makes it possible to reliably prevent contact between the stator having high temperature and the base having low temperature.

DETAILED DESCRIPTION OF PREFERRED EMBODIMENT

Figure 1:
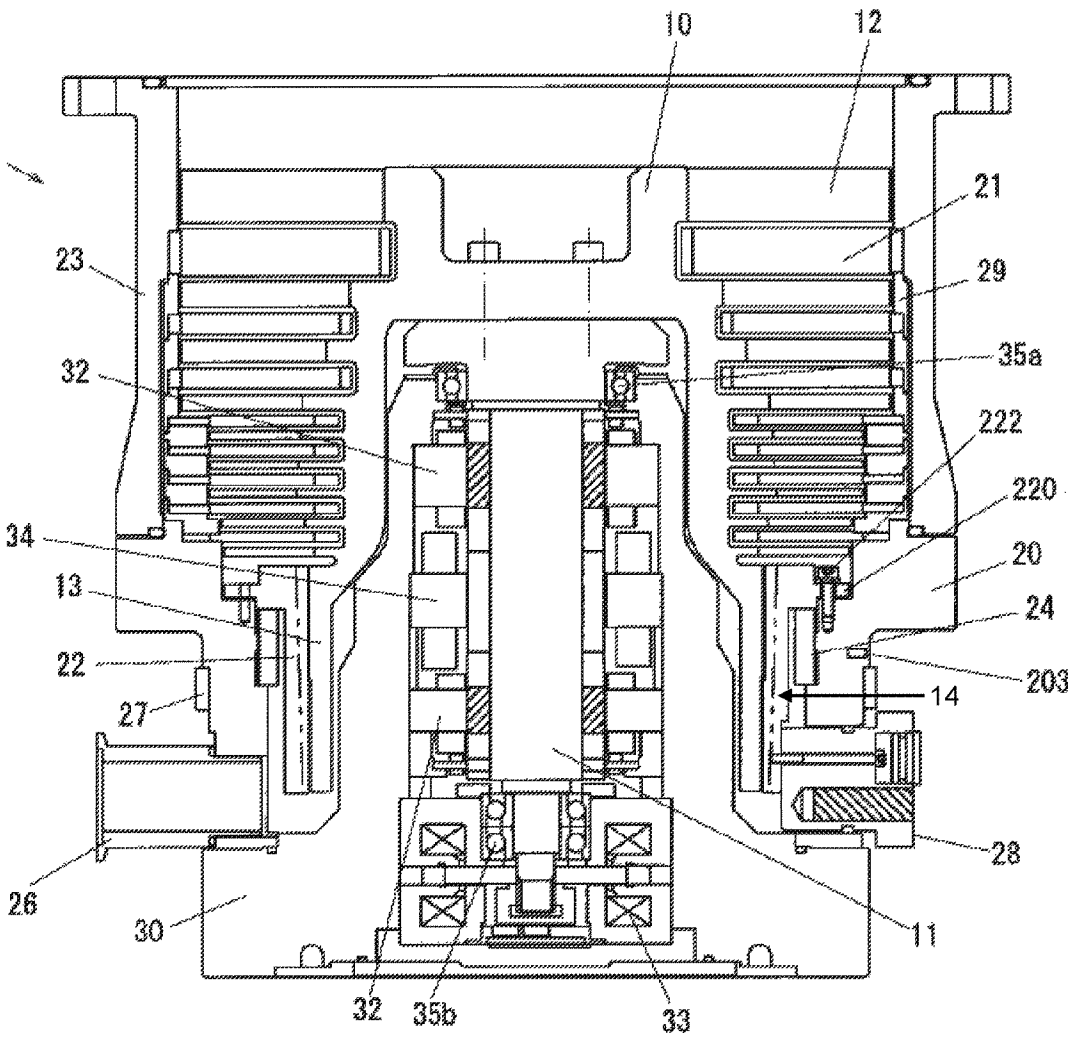
FIG. 1 is a diagram showing an embodiment of a vacuum pump according to the present invention, specifically, showing the cross section of a turbo-molecular pump.

Hereinafter, an embodiment of the present invention will be described with reference to the drawings. FIG. 1 is a diagram showing an embodiment of a vacuum pump according to the present invention, specifically, showing the cross section of a turbo-molecular pump. The turbo-molecular pump 1 is provided with a rotor 10 which includes a plurality of stages of rotor blades 12 and a rotor cylindrical section 13 formed thereon. A plurality of stages of stationary blades 21 are arranged to be stacked corresponding to the plurality of stages of rotor blades 12 inside a pump casing 23. The plurality of stages of stationary blades 21 stacked in the pump axial direction are arranged on a base 20 with spacers 29 interposed therebetween, respectively. The rotor blades 12 include a plurality of turbine blades arranged in the circumferential direction, and the stationary blades 21 include a plurality of turbine blades arranged in the circumferential direction.

A cylindrical stator 22 is arranged on the outer peripheral side of the rotor cylindrical section 13 with a gap interposed therebetween. In the present embodiment, the base 20 is a tubular member, and the stator 22 is arranged on the inner peripheral side of the base 20 and fixed to an upper end surface of the base 20 with bolts. A screw groove is formed on either an outer peripheral surface of the rotor cylindrical section 13 or an inner peripheral surface of the stator 22. The rotor cylindrical section 13 and the stator 22 together constitute a screw groove pump unit 14. Gas molecules discharged by the rotor blades 12 and the stationary blades 21 are further compressed by the screw groove pump unit 14 and eventually discharged through an exhaust port 26 disposed on the base 20.

A rotor shaft 11 is fixed to the rotor 10. The rotor shaft 11 is supported by a radial magnetic bearing 32 and an axial magnetic bearing 33 and driven to rotate by a motor 34. The rotor shaft 11 is supported by mechanical bearings 35*a*, 35*b* when the magnetic bearings 32, 33 are not operating. The radial magnetic bearing 32, the axial magnetic bearing 33, the motor 34, and the mechanical bearing 35*b* are housed in a housing 30 which is fixed to the base 20.

A conventional turbo-molecular pump may have a configuration in which the base 20 and the housing 30 are integrally formed to form a base. In any configurations, the stator 22 is arranged on the inner peripheral side of the tubular base.

Figure 2:
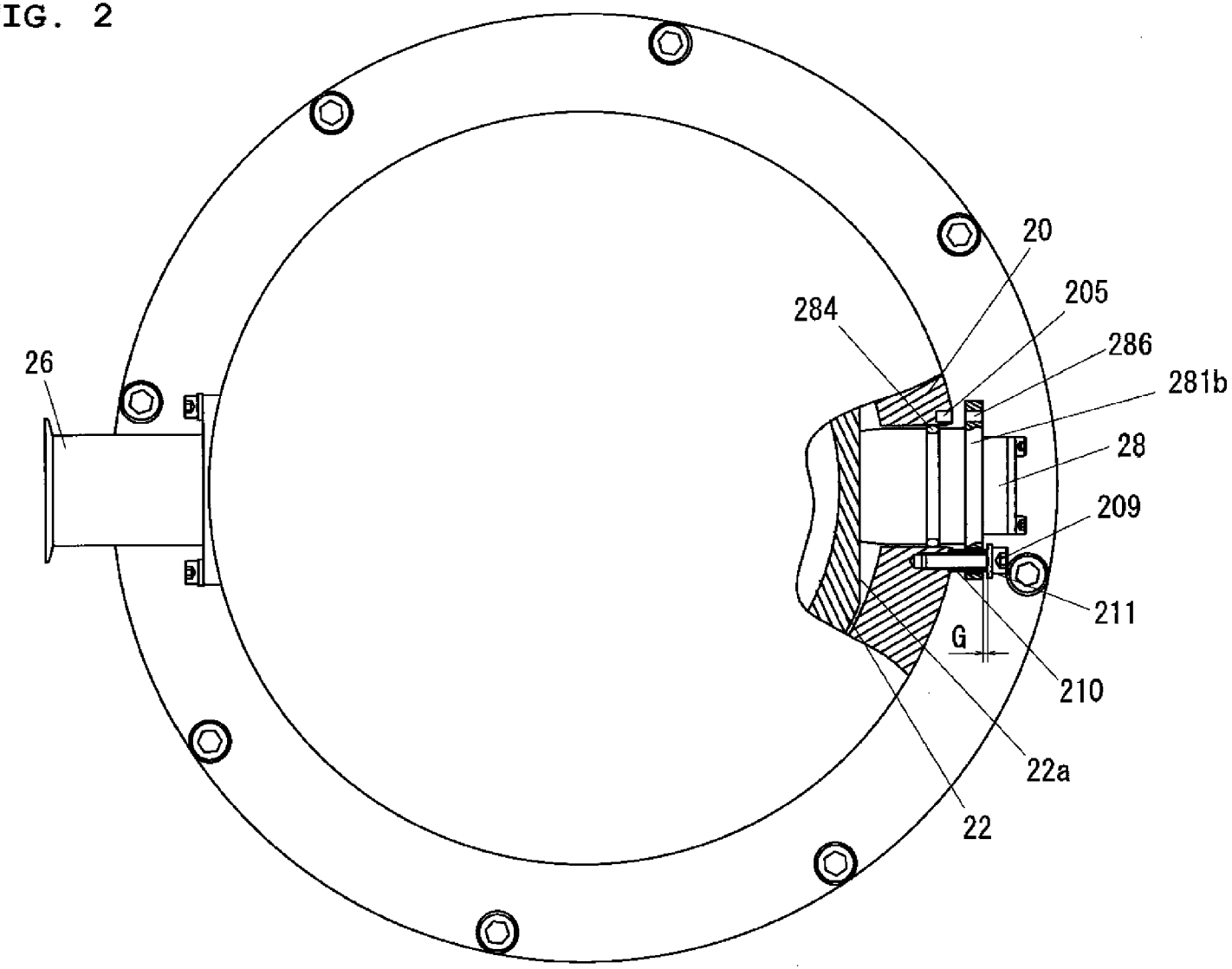
FIG. 2 is a bottom view of the turbo-molecular pump.

The base 20 is provided with a heater 27 for heating the base 20 and a temperature sensor 203 which detects the temperature of the base 20. The turbo-molecular pump 1 of the present embodiment can be used in a process involving the generation of a large amount of reaction products. A stator heating unit 28 dedicated for heating the stator 22 is fixed to the outer peripheral surface of the lower part of the stator 22. FIG. 2 is a bottom view of the turbo-molecular pump 1 in which a part thereof is shown as a cut-out section. The stator heating unit 28 penetrates the peripheral face of the base 20 from the inside through the outside thereof. Further, two or more stator heating units 28 may be provided.

Figure 3:
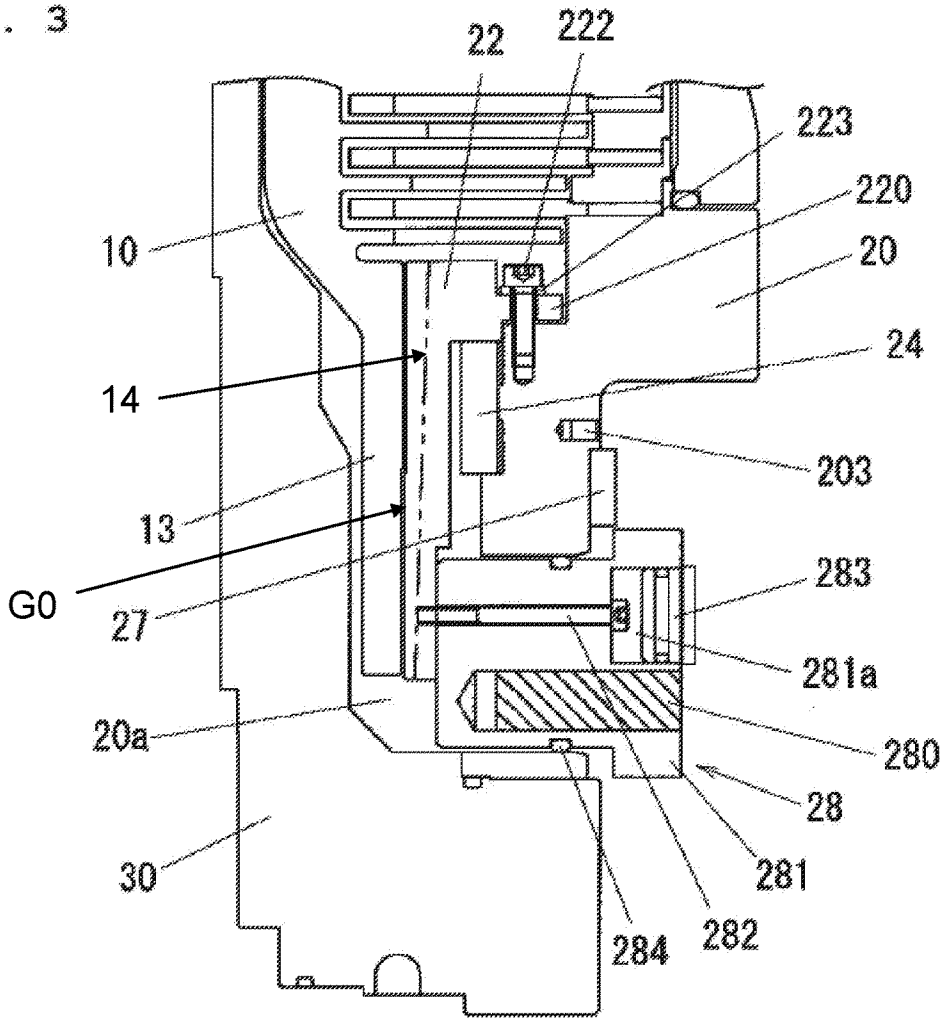
FIG. 3 is an enlarged view of a part of FIG. 1 in which a stator heating unit 28 is disposed.

FIG. 3 is an enlarged view of a part of FIG. 1 in which the stator heating unit 28 is disposed. As shown in FIG. 3, the stator heating unit 28 includes a heater block 281 to which a heater 280 is attached. The heater block 281 is fixed to an outer peripheral surface of the stator 22 with a bolt 282. A sealing plug 283 is provided on a hole 281*a* on which the bolt 282 is disposed to seal the hole 281*a*. A seal member 284 is disposed, as a vacuum seal, on a shaft section (the section penetrating the base 20) of the heater block 281. The seal member 284 seals a gap between the shaft section of the heater block 281 which penetrates the base 20 and the base 20.

As shown in FIG. 2, a flat surface section 22*a* is formed on a part of the outer peripheral surface of the stator 22. A flat surface formed on the tip of the heater block 281 is brought into contact with the flat surface section 22*a*.

When the heater block 281 is fixed to the stator 22, the heater block 281 is positioned using a positioning member (e.g., a positioning pin) in a manner to substantially align the axis of the heater block 281 with the axis of a through hole on the base. In the present embodiment, a positioning pin is used as the positioning member. A pin hole 286 with which the positioning pin is engaged is formed on the heater block 281 shown in FIG. 2. On the other hand, a pin hole 205 with which the positioning pin is engaged is formed on the base 20. The positioning pin is engaged with the pin holes 205, 286 to perform centering between the heater block 281 and the through hole on the base. The positioning pin is removed after the heater block 281 is fixed to the stator 22 with the bolt.

In the present embodiment, the stator heating unit 28 (heater block 281) is not fixed to the base 20. Thus, as shown in FIG. 2, a bolt 209 is provided on a flange section 281*b* of the heater block 281 to ensure safety when the rotor is broken. A washer 211 and a tubular spacer 210 are arranged between the bolt 209 and the base 20. The length of the spacer 210 is set in such a manner that a predetermined gap G is formed between the washer 211 and the heater block 281. The diameter of a through hole on the flange section 281*b* through which the spacer 210 passes is set to be larger than the outer diameter of the spacer 210 so as to prevent the spacer 210 from coming into contact with the heater block 281.

For example, when the stator 22 is also broken along with the breakage of the rotor, the stator heating unit 28 may jump out of the base 20. Even in such a case, the bolt 209 prevents the stator heating unit 28 from jumping out of the base 20 in the present embodiment. Further, even when the stator 22 or the heater block 281 thermally expands, the formed gap G prevents contact between the bolt 209 and the heater block 281.

Referring back to FIG. 1, the stator 22 is fixed to the base 20 with bolts 222. A heat insulation member 24 (e.g., a cylindrical heat insulation member) is arranged between the stator 22 and the base 20. Thus, the stator 22 is supported by the heat insulation member 24 in the axial direction, and a gap is formed between a bottom surface of the flange section 220 of the stator 22 and an upper surface of the base 20.

In the turbo-molecular pump 1 of the present embodiment, the stator heating unit 28 directly heats the stator 22 placed on the heat insulation member 24 as described above. Further, heating performed by the stator heating unit 28 is controlled to maintain the temperature of the stator 22 at a temperature (e.g., 100° C. or more) higher than a conventional temperature to thereby reliably prevent deposition of reaction products on the stator 22. In the following, the deposition prevention temperature is denoted by Ts. In a practical sense, the deposition prevention temperature Ts includes a predetermined temperature range (Ts1 to Ts2). Thus, maintaining the stator 22 at the deposition prevention temperature Ts means maintaining the stator 22 within the temperature range (Ts1 to Ts2). That is, the heater 280 is controlled to allow the temperature of the stator 22 to fall within the temperature range (Ts1 to Ts2).

In the present embodiment, the stator 22 is not in contact with the base 20. Thus, heat is transferred from the stator 22 to the base 20 through substantially only the heat insulation member 24. Therefore, when a difference in temperature between the base 20 and the stator 22 is large, the amount of heat transfer from the stator 22 to the base 20 through the heat insulation member 24 becomes remarkably large. In view of this, the base 20 is heated by the heater 27 in accordance with the heat insulation property of the heat insulation member 24 so as to prevent a difference in temperature between the base 20 and the stator 22 from increasing to thereby suppress heat transfer from the stator 22 to the base 20 through the heat insulation member 24.

A washer 223 of each of the bolts 222 is formed of a member having a smaller thermal conductivity than the base member and functions as a heat insulation member which suppresses heat transfer from the stator 22 to the base 20. For example, when an aluminum material is used in the base 20, a material having a smaller thermal conductivity than the aluminum material (e.g., a stainless material) is used in the washer 223. Although, in the present embodiment, the heat insulation member 24 as illustrated in FIG. 3 is interposed between the stator 22 and the base 20 to achieve heat insulation, the heat insulation structure is not limited to this structure. For example, a heat insulation member may be interposed between the flange section 220 of the stator 22 and the base 20.

As described above, the turbo-molecular pump 1 of the present embodiment is configured in such a manner that the stator heating unit 28 directly heats the stator 22 and heat transfer from the stator 22 to the base 20 through the heat insulation member 24 is reduced as far as possible. In this manner, the turbo-molecular pump 1 is contrived to prevent the stator 22 and the base 20 from coming into contact with each other even when the stator 22 is deformed by expansion due to temperature rise.

Figure 4:
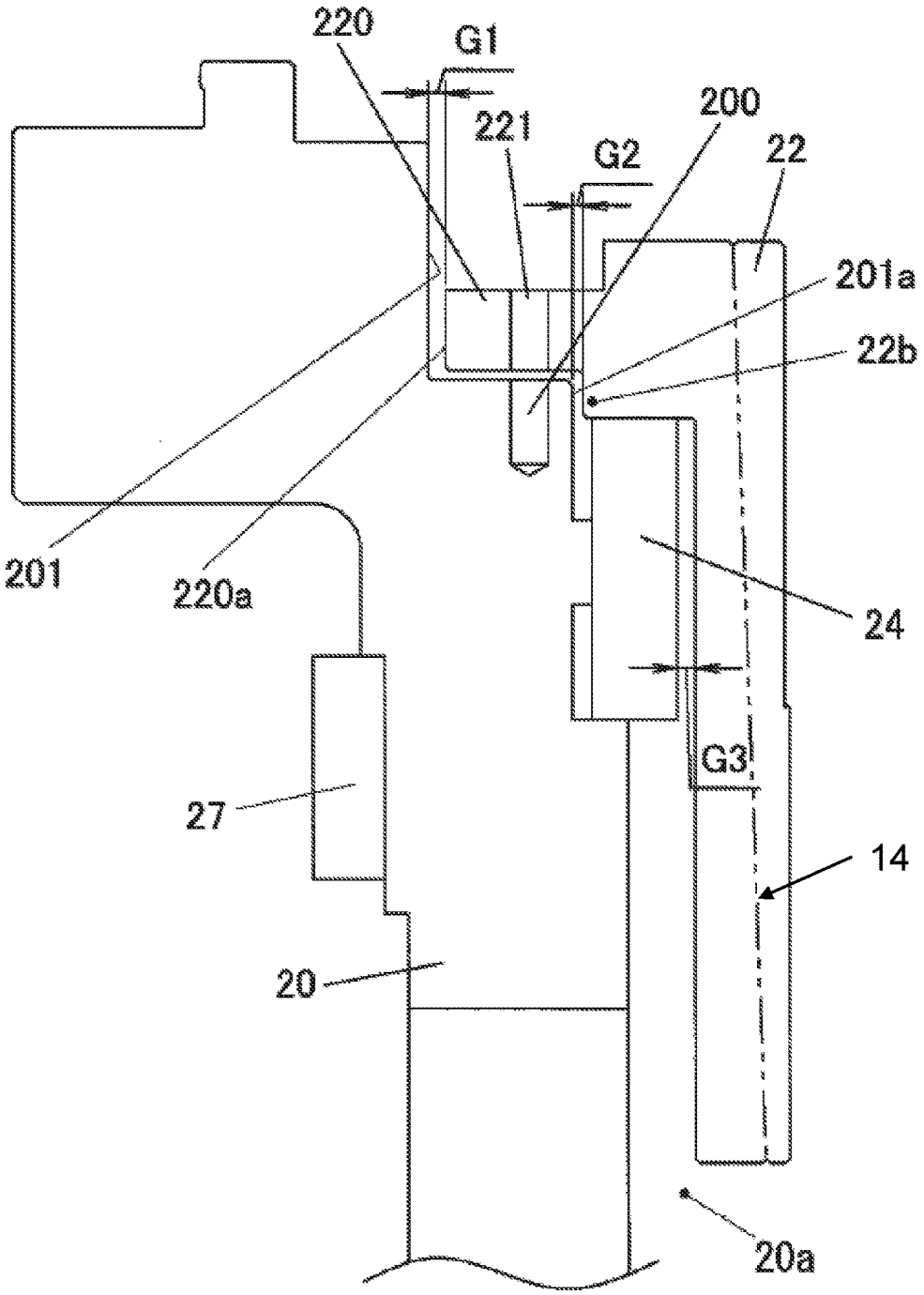
FIG. 4 is an enlarged view of a fixing part between a stator 22 and a base 20 shown on the left side of FIG. 1.

FIG. 4 is an enlarged view of a fixing part between the stator 22 and the base 20 shown on the left side of FIG. 1. As shown in FIG. 4, the heat insulation member 24 is arranged between the stator 22 which is arranged on the inner peripheral side of the base 20 and the base 20. Thus, a gap is formed between the flange section 220 of the stator 22 and the upper surface of the base 20, and the bottom surface of the flange section 220 is therefore not in contact with the base 20. Further, gaps G1 to G3 (the dimensions of the gaps are also denoted by G1, G2, and G3) as illustrated in FIG. 4 are formed around the outer peripheral surface in the radial direction of the stator 22.

In the present embodiment, when the stator 22 is fixed to the base 20 with bolts, centering is performed using pins, and the stator 22 is then fixed to the base 20 with the bolts 222 illustrated in FIG. 1. The pins used in the centering are removed after the fixing with the bolts. As shown in FIG. 4, two or more pin holes 200 are formed on the base 20. On the other hand, pinholes 221 are formed on the stator 22 at positions facing the respective pin holes 200 of the base 20.

When the stator 22 is fixed to the base 20, for example, positioning pins are attached to the respective pin holes 200 of the base 20, and the stator 22 is then placed on the base 20 (actually placed on the heat insulation member 24) in a manner to allow the positioning pins to be engaged with the respective pin holes 221. The positioning pins may be inserted into the pin holes 200 and the pin holes 221 after the stator 22 is placed on the base 20. Then, the stator 22 is fixed to the base 20 with the bolts 222. Upon completion of the fixing of the stator 22 to the base 20 with the bolts, the positioning pins are removed from the pin holes 200, 221.

The positioning pins are removed after the fixing with the bolts in order to prevent heat transfer from the stator 22 to the base 20 through the positioning pins and, in addition, to prevent the positioning pins loosely fitted with the pin holes 200, 221 from being detached and falling into the pump. It is needless to say that, when positioning pins having a high heat insulation property and sufficient strength are used, the positioning pins may be driven into the respective pin holes 200 of the base 20 to leave the positioning pins.

Next, the gaps G1 to G3 will be described. The gap G1 is a gap formed between an outer peripheral surface 220*a* of the flange section 220 of the stator 22 and an inner peripheral surface 201 of the base 20. The gap G2 is a gap formed between the outer peripheral surface of a step 22*b* formed on the bottom surface of the flange section 220 and an inner peripheral surface 201*a* of the base 20. The gap G3 is a gap formed between the outer peripheral surface of a cylindrical section of the stator 22 and the inner peripheral surface of the heat insulation member 24. When the stator 22 is heated to have a high temperature (e.g., 100° C. or more), the stator 22 thermally expands in the radial direction, which makes the gaps G1 to G3 smaller.

A conventional turbo-molecular pump typically has a fitting structure between the outer peripheral surface 220*a* of the flange section 220 of the stator 22 and the inner peripheral surface 201 of the base 20 to position the stator 22 with respect to the base 20. The positioning is performed in order to concentrically align the axis of the rotor cylindrical section 13 with the axis of the stator 22 so that a gap between the rotor cylindrical section 13 and the stator 22 becomes uniform. The gap between the rotor cylindrical section 13 and the stator 22 is approximately 1 mm. Thus, a clearance of the fitting between the outer peripheral surface 220*a* and the inner peripheral surface 201, that is, the dimension of the gap G1 of FIG. 4 is approximately 0.1 mm.

Since there is a fitting configuration between the outer peripheral surface 220*a* and the inner peripheral surface 201 in this manner, the outer peripheral surface 220*a* and the inner peripheral surface 201 are partially in contact with each other. Even if a gap is formed between the outer peripheral surface 220*a* and the inner peripheral surface 201 by a perfect concentric state, the gap is approximately 0.1 mm and therefore small. Thus, when the outer diameter dimension of the flange section 220 increases due to thermal expansion of the stator 22, the outer peripheral surface 220*a* of the flange section 220 may come into contact with the base 20. In such a case, heat of the stator 22 escapes to the base 20.

On the other hand, in the present embodiment, the stator 22 is positioned with respect to the base 20 using the positioning pins. Thus, a fitting structure is not required between the outer peripheral surface 220*a* and the inner peripheral surface 201, and the gap G1 can be set to be sufficiently large. Therefore, it is possible to reliably prevent the outer peripheral surface 220*a* of the flange section 220 from coming into contact with the inner peripheral surface 201 of the base 20 when the stator 22 thermally expands.

When the bolt 222 which fixes the stator 22 is loosened, the stator 22 may be laterally shifted in the radial direction with respect to the base 20. In the present embodiment, the dimension of the gap G1 is set to be sufficiently large to prevent contact caused by thermal expansion as described above. Thus, the gap G2 which is smaller than the gap G1 is provided to prevent contact between the stator 22 and the rotor cylindrical section 13 when the stator 22 is laterally shifted. When the gap between the rotor cylindrical section 13 and the stator 22 is denoted by G0, as shown in FIG. 3, the gap G2 is set to satisfy "G0>G2" and also to be larger than a change in the radial dimension of the stator 22 caused by thermal expansion. Further, the gap G3 between the outer peripheral surface of the cylindrical section of the stator 22 and the inner peripheral surface of the heat insulation member 24 is set to be larger than G2. With such a configuration, even when the stator 22 is laterally shifted, the step 22*b* of the stator 22 abuts on the inner peripheral surface 201*a* of the base 20 to prevent contact between the stator 22 and the rotor cylindrical section 13.

In the above embodiment, the positioning pins are engaged with the pin holes 221, 200 to position the stator 22 with respect to the base 20. Alternatively, a positioning member other than a pin may be used as in first to fifth modifications shown in FIGS. 5 to 9.

First Modification

Figure 5:
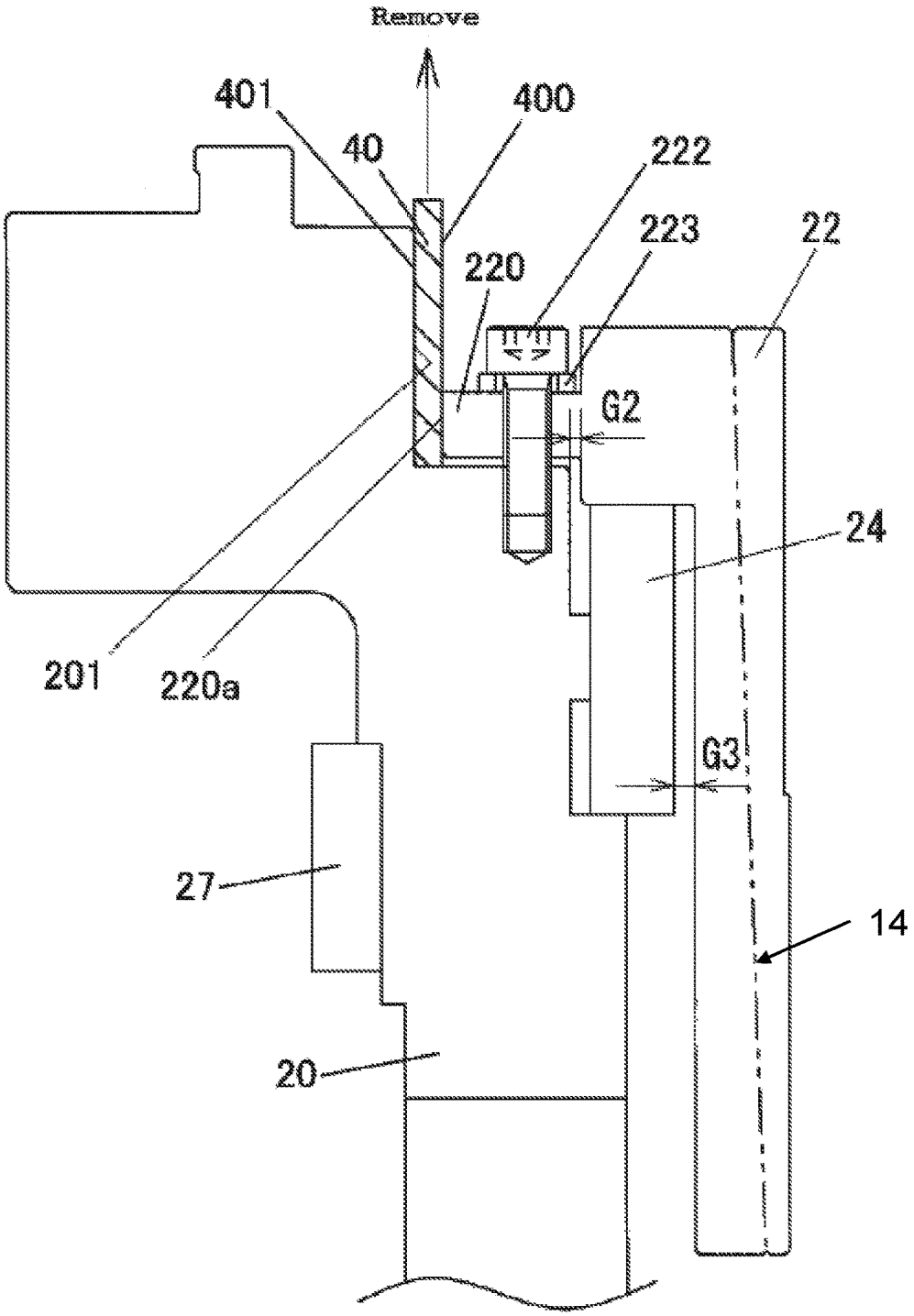
FIG. 5 is a diagram showing a first modification.

FIG. 5 is a diagram showing a first modification, specifically, an enlarged view of a stator 22 as with FIG. 4. FIG. 5 shows a case in which positioning is performed by an inner peripheral surface 201 of a base 20 and an outer peripheral surface 220*a* of a flange section 220. In this case, a positioning member 40 may have a cylindrical shape or may, for example, be two of four divisions formed by dividing a cylindrical member in the circumferential direction. In the following, the cylindrical positioning member 40 will be described. There is a fitting relation (loose fit) between an outer peripheral surface 401 of the positioning member 40 and the inner peripheral surface 201 of the base 20. First, the positioning member 40 is arranged on the base 20.

Then, the stator 22 is arranged on the inner peripheral side of the positioning member 40. There is a fitting relation (loose fit) between the outer peripheral surface 220*a* of the flange section 220 of the stator 22 and an inner peripheral surface 400 of the positioning member 40. Arranging the stator 22 on the inner peripheral side of the positioning member 40 allows the stator 22 to be concentrically positioned with respect to the base 20. Then, the stator 22 is fixed to the base 20 with bolts 222. Then, the positioning member 40 is removed to finish an operation of fixing the stator 22 to the base 20.

Second Modification

Figure 6:
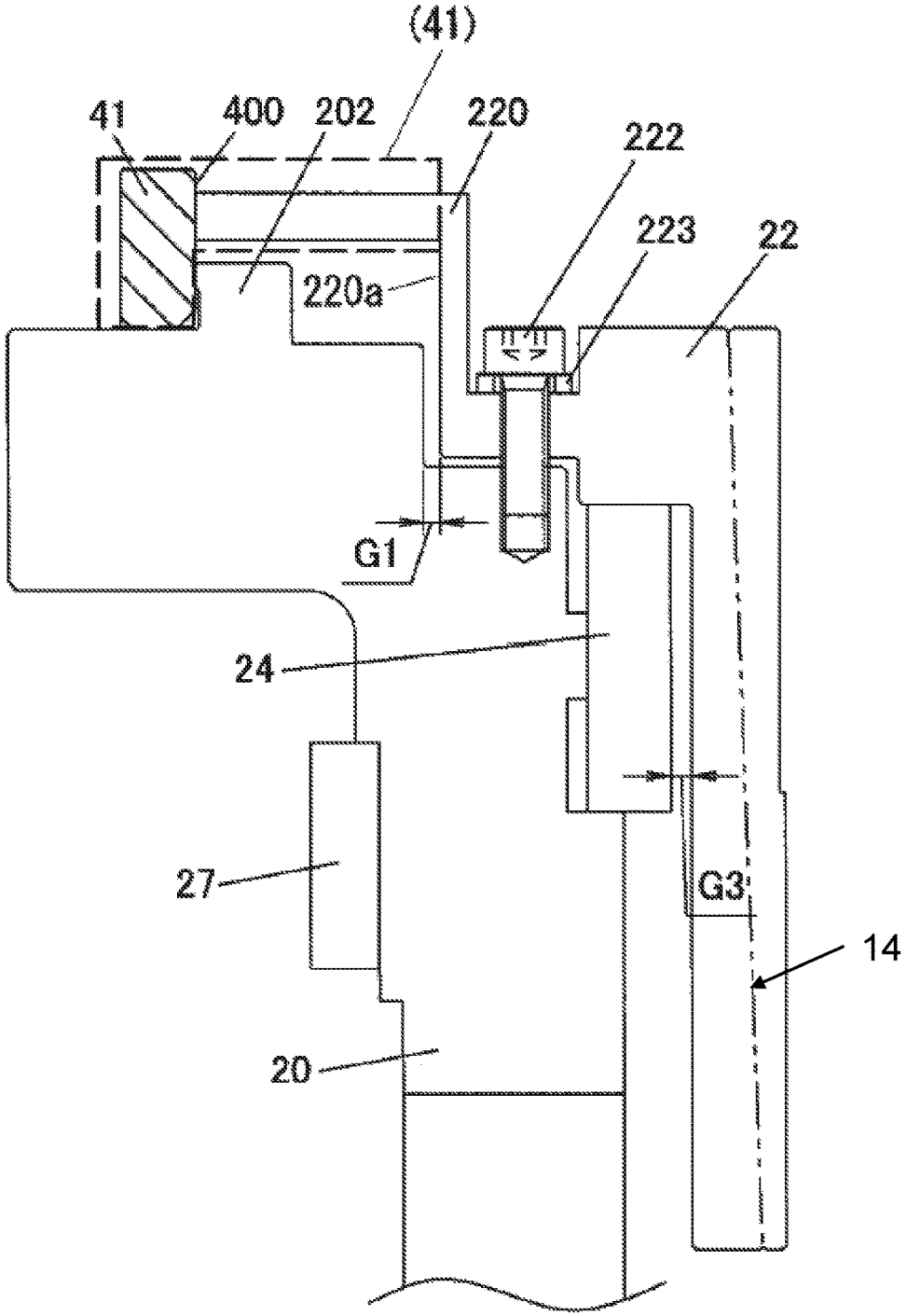
FIG. 6 is a diagram showing a second modification.

FIG. 6 is a diagram showing a second modification. In the second modification, positioning is performed by an outer peripheral surface of an annular section 202 formed on a base 20 and an outer peripheral surface of a flange section 220 of a stator 22. In this case, a cylindrical positioning member 41 is used to perform positioning. The positioning member 41 is not limited to a cylindrical shape. For example, two of four divisions formed by dividing a cylindrical member in the circumferential direction, the two divisions being connected by a horizontal plate, may be used. The outer diameter of the annular section 202 is equal to the outer diameter of the flange section 220. There is a fitting relation (loose fit) between the outer peripheral surfaces of the annular section 202 and the flange section 220 and an inner peripheral surface 400 of the positioning member 41. After the stator 22 is positioned by the positioning member 41, the stator 22 is fixed to the base 20 with bolts 222. After the stator 22 is fixed to the base 20 with the bolts 222, the positioning member 41 is removed.

In the example shown in FIG. 6, the positioning member 41 used in the case in which the outer diameter of the annular section 202 is equal to the outer diameter of the flange section 220 is shown. Alternatively, for example, when the flange section 220 has a shape in which the outer peripheral surface thereof is located at the position of the outer peripheral surface 220*a* as shown in FIG. 5, a positioning member 41 as indicated by a broken line may be used. Also in this case, positioning is performed by the outer peripheral surface of the stator 22 and the outer peripheral surface of the annular section 202.

Third Modification

Figure 7:
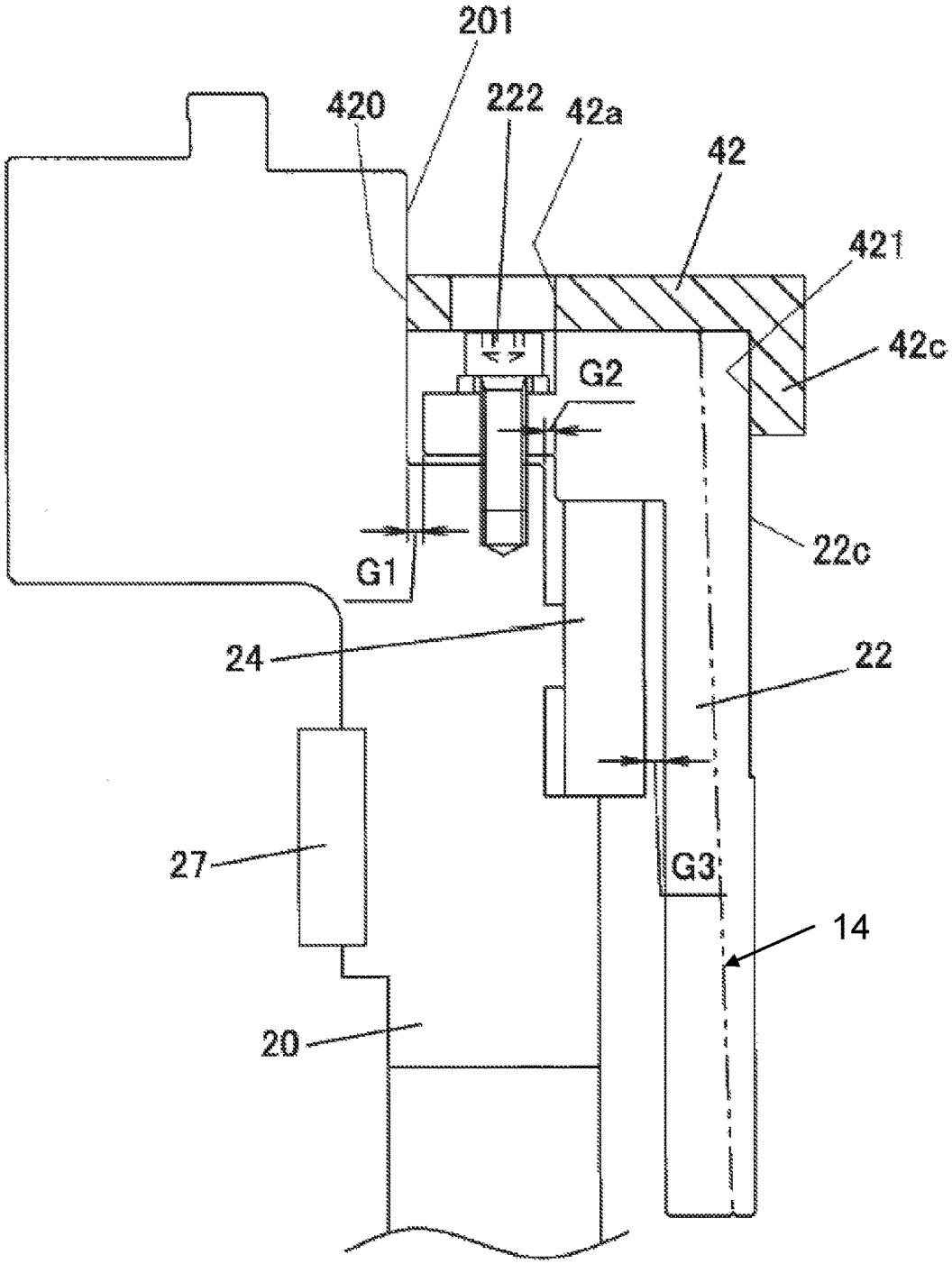
FIG. 7 is a diagram showing a third modification.

FIG. 7 is a diagram showing a third modification. In the third modification, positioning is performed by an inner peripheral surface 201 of a base 20 and an inner peripheral surface 22*c* of a stator 22. First, the stator 22 is arranged on the base 20. Then, a ring-like positioning member 42 is arranged on the stator 22. There is a fitting relation (loose fit) between an outer peripheral surface 420 of the positioning member 42 and the inner peripheral surface 201 of the base 20. On the other hand, there is a fitting relation (loose fit) between an outer peripheral surface 421 of a rink-like projection 42*c* formed on the positioning member 42 and the inner peripheral surface 22*c* of the stator 22. Thus, the stator 22 is positioned with respect to the base 20 by fitting the outer peripheral surface 420 with the inner peripheral surface 201 and fitting the outer peripheral surface 421 with the inner peripheral surface 22*c*.

The stator 22 is fixed to the base 20 with bolts 222. Through holes 42*a* are formed on the positioning member 42 at positions facing the respective bolts 222. Thus, after the stator 22 is positioned by the positioning member 42, a fastening operation with the bolts 222 is performed through the through holes 42*a*. Upon completion of the fixing of the stator 22 to the base 20 with the bolts 222, the positioning member 42 is removed.

Fourth Modification

Figure 8:
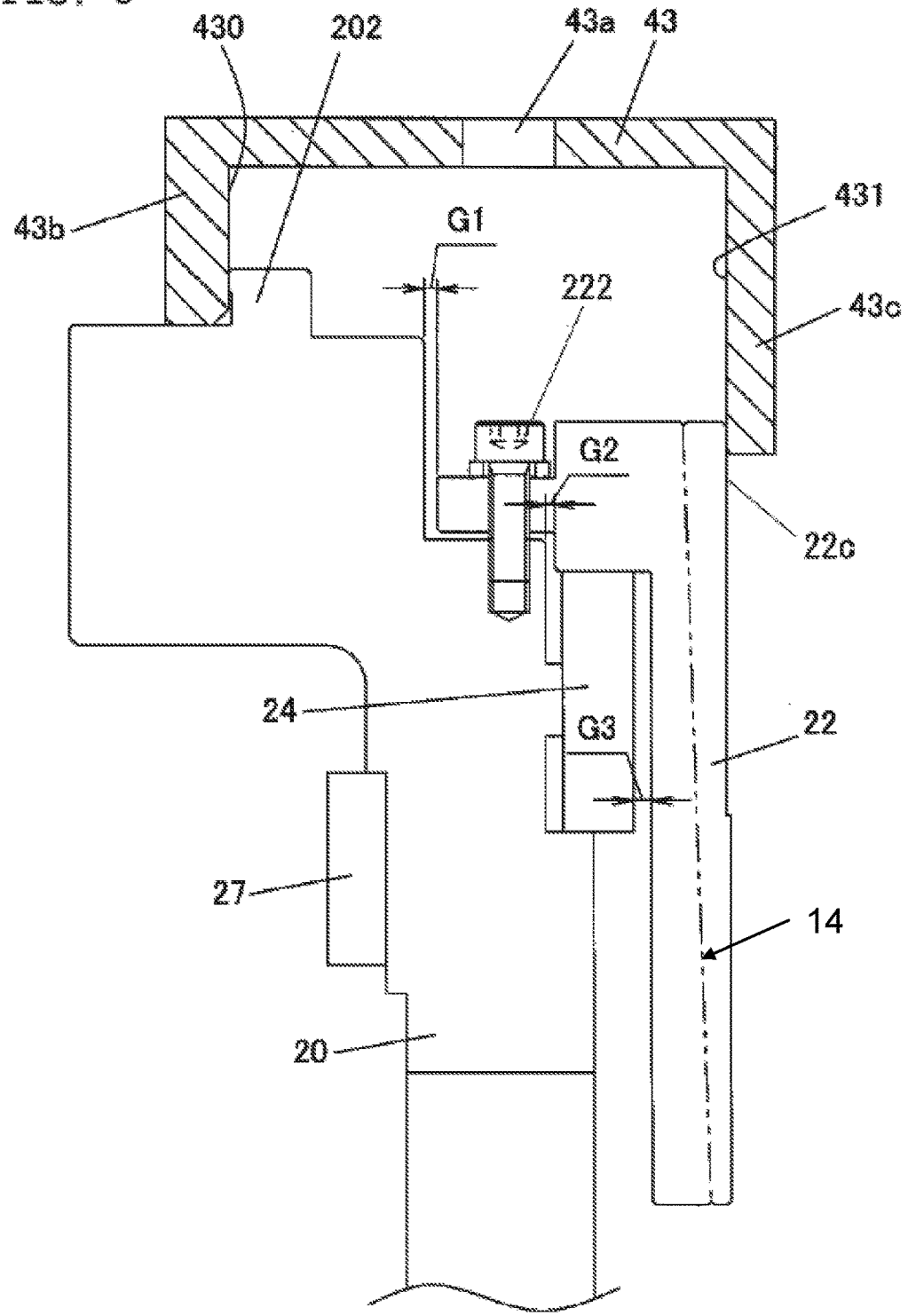
FIG. 8 is a diagram showing a fourth modification.

FIG. 8 is a diagram showing a fourth modification. In the fourth modification, positioning is performed by an outer peripheral surface of an annular section 202 formed on a base 20 and an inner peripheral surface 22*c* of a stator 22. A positioning member 43 is a ring-like member. A ring-like outer peripheral projection 43*b* and a ring-like inner peripheral projection 43*c* are formed on the bottom surface of the positioning member 43. When positioning of the stator 22 is performed, an inner peripheral surface 430 of the outer peripheral projection 43*b* is fitted with the outer peripheral surface of the annular section 202 of the base 20, and an outer peripheral surface 431 of the inner peripheral projection 43*c* is fitted with the inner peripheral surface 22*c* of the stator 22. As a result, the stator 22 is positioned with respect to the base 20. Then, bolts 222 are fastened through through holes 43*a* formed on the positioning member 43 to fix the stator 22 to the base 20. Then, the positioning member 43 is removed.

Fifth Modification

Figure 9:
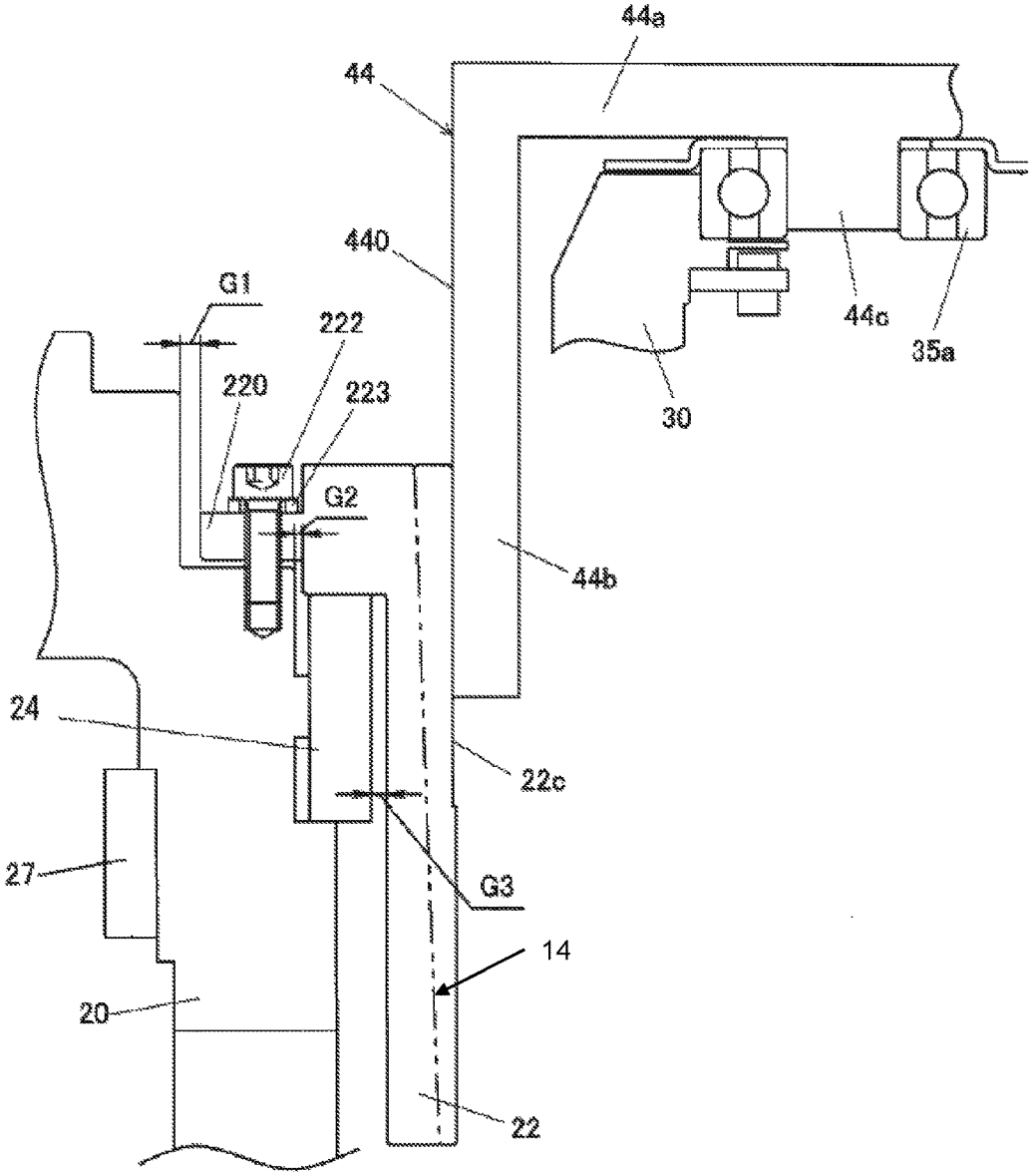
FIG. 9 is a diagram showing a fifth modification.

FIG. 9 is a diagram showing a fifth modification. In the fifth modification, positioning is performed by an inner peripheral surface 22*c* of a stator 22 and an inner peripheral surface of a mechanical bearing 35*a* which is fixed to a housing 30. FIG. 9 schematically shows a part of the housing 30 on which the mechanical bearing 35*a* is provided. For illustration reasons, the illustrated positional relationship between the housing 30 and abase 20 to which the housing 30 is fixed differs from an actual positional relationship therebetween.

The positioning member 44 includes a flat plate section 44*a*, a cylindrical section 44*b* which projects downward (in the drawing) from the flat plate section 44*a*, and a columnar section 44*c* which projects downward (in the drawing) and is concentric with the cylindrical section 44*b*. There is a fitting relation (loose fit) between the outer peripheral surface of the columnar section 44*c* and the inner peripheral surface of the mechanical bearing 35*a*. Further, there is a loose fit relation between an outer peripheral surface 440 of the cylindrical section 44*b* of the positioning member 44 and the inner peripheral surface 22*c* of the stator 22. For example, two of four divisions formed by dividing the cylindrical section 44*b* in the circumferential direction may be provided instead of the cylindrical section 44*b*.

When positioning between the base 20 and the stator 22 is performed, the positioning member 44 is placed on the housing 30 in a manner to allow the columnar section 44*c* to be inserted into the inner peripheral side of the mechanical bearing 35*a*. Then, the stator 22 is placed on the base 20 in a manner to allow the cylindrical section 44*b* of the positioning member 44 to be inserted into the inner peripheral side of the stator 22. As a result, the stator 22 is positioned with respect to the base 20. Then, the stator 22 is fixed to the base 20 using bolts 222. Thereafter, the positioning member 44 is removed from the housing 30.

As described above, the vacuum pump of the present embodiment is provided with the rotor cylindrical section 13, the cylindrical stator 22 which discharges gas in cooperation with the rotor cylindrical section 13, and the tubular base 20 to which the stator 22 is fixed. The stator 22 has no fitting structure with respect to the base 20, and is concentrically fixed to the base 20. In this case, there is no fitting structure on the radial gap G1. Thus, the radial gap G1 can be set to be sufficiently large in consideration of thermal expansion of the stator 22. As a result, it is possible to reliably prevent contact between the stator 22 and the base 20 caused by thermal expansion.

For example, positioning pins are used as a positioning jig for achieving a concentric state between the stator 22 and the base 20. Engaging the positioning pins with the pin holes 200 of the base 20 and the pin holes 221 of the stator 22 enables the stator 22 and the base 20 to be concentric with each other. The positioning pins are preferably removed after the stator 22 is fixed to the base 20 with bolts.

The stator 22 and the base 20 preferably include abutment sections (corresponding to the inner peripheral surface 201*a* of the base 20 and the step 22*b* of the stator 22) which have a radial gap formed therebetween in the concentric state and come into contact with each other when the stator 22 is radially shifted to prevent contact between the stator 22 and the rotor cylindrical section 13. In this case, since the gap G2 is smaller than the gap G0, even when the stator 22 is laterally shifted as shown in FIG. 11 and the inner peripheral surface 201*a* of the base 20 and the step 22*b* of the stator 22 thereby come into contact with each other, the stator 22 and the rotor cylindrical section 13 do not come into contact with each other.

In the above embodiment, the abutment sections having the gap G2 are provided in the configuration in which the stator 22 and the base 20 are arranged with, for example, the radial gap G1 of a non-fitting structure interposed therebetween and concentrically arranged by the positioning jig which is removed after the fixing with the bolts. Alternatively, the abutment sections having the gap G2 may also be applied to a positioning structure as shown in FIG. 10.

Figure 10:
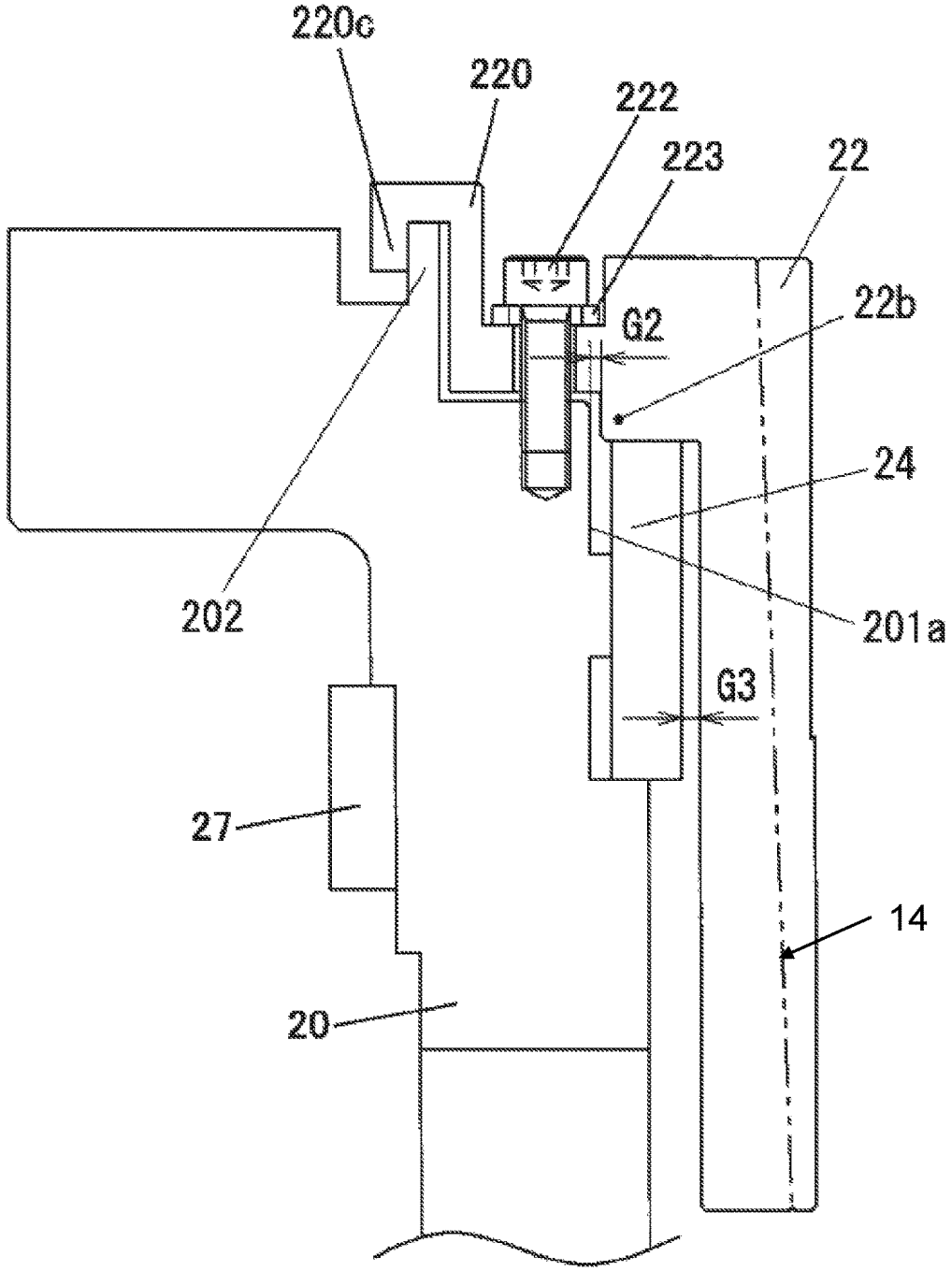
FIG. 10 is a diagram showing another example of a positioning structure to which a gap G2 can be applied.

In the example shown in FIG. 10, there is a fitting relation between an inner peripheral surface of an annular engagement section 220*c* which is formed on the flange section 220 of the stator 22 and the outer peripheral surface of the annular section 202 of the base 20. Thus, when the stator 22 thermally expands, a gap between the inner peripheral surface of the annular engagement section 220*c* and the outer peripheral surface of the annular section 202 of the base 20 becomes larger. Thus, thermal transfer from the stator 22 to the base 20 is prevented. On the other hand, when the bolt 222 which fixes the stator 22 is loosened, the stator 22 may be laterally shifted by a clearance between the bolt insertion hole on the flange section 220 and the bolt 222. However, even when the lateral shift of the stator 22 occurs, the inner peripheral surface 201*a* of the base 20 and the step 22*b* of the stator 22 abut on each other, thereby making it possible to prevent the rotor cylindrical section 13 and the stator 22 from coming into contact with each other.

Figure 11:
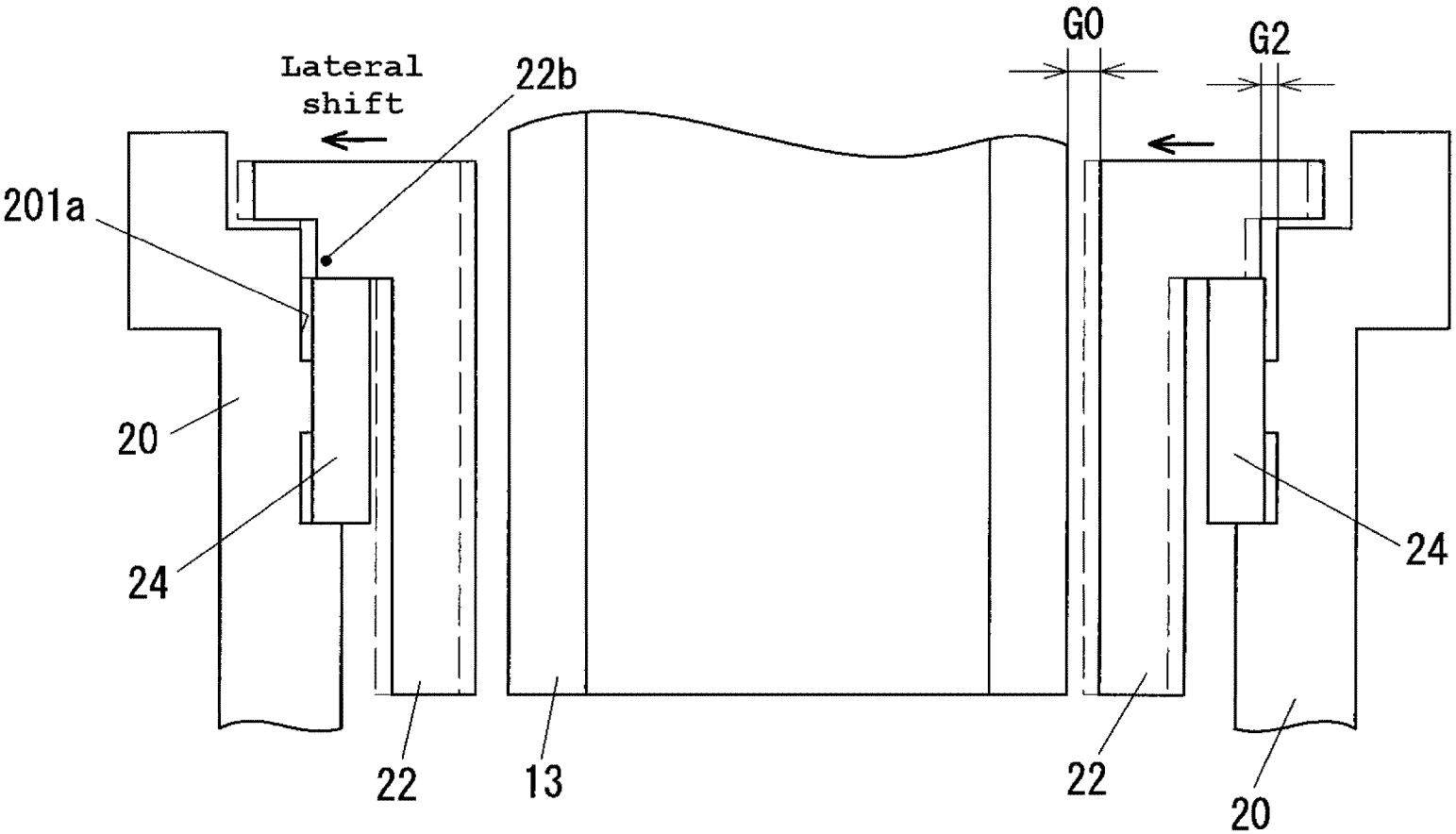
FIG. 11 is a diagram illustrating an effect of the gap G2.
Figure 12B:
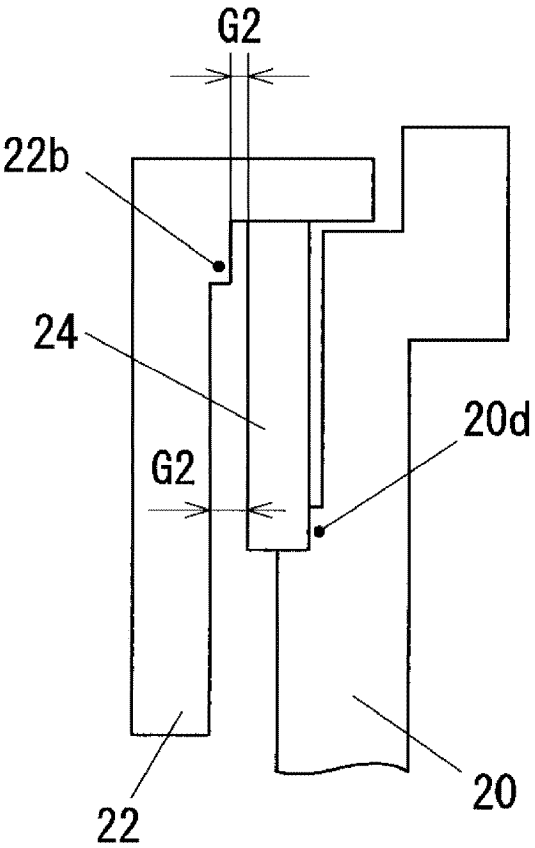
FIGS. 12A and 12B are diagrams showing a case in which the gap G2 is formed between the stator 22 and a heat insulation member 24.
Figure 12A:
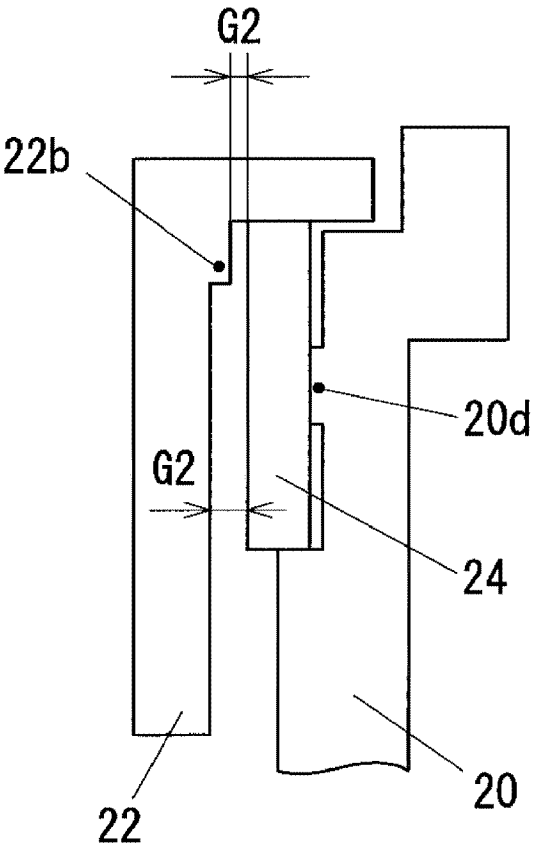

In the above embodiment, the gap G2 (>G0, G1, and G3) between the step 22*b* of the stator 22 and the inner peripheral surface 201*a* of the base 20 prevents contact between the stator 22 and the rotor cylindrical section 13 when the stator 22 is laterally shifted as shown in FIG. 11. Configurations as shown in FIGS. 12A and 12B may be employed as such a contact prevention structure. In the example shown in FIG. 12A, the step 22*b* of the stator 22 faces the inner peripheral surface of the heat insulation member 24. The dimension of a gap between the step 22*b* and the heat insulation member 24 is set to G2. Thus, even when bolt fixation is loosened and the stator 22 is thereby shifted in the axial direction, the step 22*b* abuts on the heat insulation member 24, thereby making it possible to prevent contact between the stator 22 and the rotor cylindrical section 13.

The heat insulation member 24 is formed of a material having a smaller thermal conductivity than the stator 22 and the base 20. For example, when the stator 22 and the base 20 are formed of an aluminum alloy and the heat insulation member 24 is formed of a stainless material, a gap between a projection 20*d* (having a fitting structure with respect to the heat insulation member 24) of the base 20 and the outer peripheral surface of the heat insulation member 24 becomes larger due to thermal expansion caused by temperature rise, and, on the other hand, the gap G2 becomes smaller. Thus, even when the gap between the projection 20*d* and the heat insulation member 24 becomes larger due to thermal expansion and the heat insulation member 24 placed on the stator 22 is thereby laterally shifted, the gap G2 becomes smaller as described above to reduce the amount of lateral shift of the stator 22 with respect to the heat insulation member 24. Therefore, it is possible to reduce the amount of lateral shift of the stator 22 to the same degree as the gap G2 before the thermal expansion. As a result, it is possible to prevent contact between the stator 22 and the rotor cylindrical section 13. As shown in FIG. 12B, the projection 20*d* of the base 20 which has a fitting structure with respect to the outer peripheral surface of the heat insulation member 24 may be located on the lower end part of the heat insulation member 24.

The above embodiment and the modifications may be used independently or in combination to achieve the effects of the embodiment and the modifications independently or in a synergetic manner. Further, the present invention is not limited at all to the above embodiment unless the features of the present invention are impaired.

For example, in the above embodiment, the stator 22 is heated using the stator heating unit 28 which penetrates the base 20. Alternatively, a heater may be embedded in the stator 22. Further, in the above embodiment, the stator heating unit 28 directly heats the stator 22 so that the stator temperature becomes higher than the base temperature. Alternatively, the present invention can also be applied to a case in which the stator temperature becomes higher than the base temperature by heat generation of gas during discharge of gas.

The present invention can be applied not only to a turbo-molecular pump, but also to a vacuum pump which is provided with a cylindrical rotor and a cylindrical stator.

What is claimed is:

1. A vacuum pump comprising:

a cylindrical rotor;

a cylindrical stator which discharges gas in cooperation with the rotor; and a tubular base to which the stator is fixed in a concentric state; a heat insulation member that supports the stator in the axial direction such that the stator does not directly come into contact with the base;

a stator-side pin hole formed on the stator for receiving a removable positioning pin; and a base-side pin hole formed on the base for receiving the removable positioning pin;

wherein the stator is fixed to the base with the removable positioning pin removed from the stator-side pin hole and the base-side pin hole, the stator-side pin hole and the base-side pin hole remaining vacant.

2. The vacuum pump according to claim 1, wherein the stator and the base respectively include an abutment section having a radial gap formed there between in the concentric state and coming into contact with each other in a state in which the stator is radially shifted to prevent contact between the stator and the rotor.

3. A vacuum pump comprising: a cylindrical rotor; a cylindrical stator which discharges gas in cooperation with the rotor; a base fixed to the stator in a concentric state; a heat insulation member that supports the stator in the axial direction such that the stator does not directly come into contact with the base; wherein a first gap exists between an outer peripheral surface of the stator and an inner peripheral surface of the base in a state in which the stator is thermally expanded in a radial direction, wherein the stator and the base respectively include an abutment section having a second gap which is a radial gap formed there between in the concentric state and coming into contact with each other in a state in which the stator is radially shifted to prevent contact between the stator and the rotor, wherein a third gap exists between the outer peripheral surface of the stator and an inner peripheral surface of the heat insulation member; wherein the second gap is smaller than the first gap, and wherein the second gap is larger than a change in the radial dimension of the stator caused by thermal expansion; and wherein the third gap is larger than the second gap.

4. The vacuum pump according to claim 1, further comprising:

a base heater for heating the base, to prevent a difference in temperature between the base and the stator from increasing to thereby suppress heat transfer from the stator to the base through the heat insulation member.

5. The vacuum pump according to claim 3, further comprising:

a base heater for heating the base to prevent a difference in temperature between the base and the stator from increasing to thereby suppress heat transfer from the stator to the base through the heat insulation member.

6. The vacuum pump according to claim 1, wherein the heat insulation member is made from a stainless material, and wherein the stator and the base are made from aluminum material.

7. The vacuum pump according to claim 3, wherein the heat insulation member is made from a stainless material, and wherein the stator and the base are made from aluminum material.

8. The vacuum pump according to claim 1, wherein the stator is fixed to the base by a bolt having a washer, and thermal conductivity of the washer of the bolt is smaller than thermal conductivity of the base.

9. The vacuum pump according to claim 3, wherein the stator is fixed to the base by a bolt having a washer, and thermal conductivity of the washer of the bolt is smaller than thermal conductivity of the base.

* * * * *